United States Patent [19]

Perr

[11] Patent Number: 4,911,127

[45] Date of Patent: Mar. 27, 1990

[54] FUEL INJECTOR FOR AN INTERNAL COMBUSTION ENGINE

[75] Inventor: Julius P. Perr, Columbus, Ind.

[73] Assignee: Cummins Engine Company, Inc., Columbus, Ind.

[21] Appl. No.: 379,331

[22] Filed: Jul. 12, 1989

[51] Int. Cl.[4] ..... F02M 39/00

[52] U.S. Cl. ..... 123/446; 123/447

[58] Field of Search ..... 123/506, 447, 446, 467, 123/458, 500, 501, 503; 239/88–96

[56] References Cited

U.S. PATENT DOCUMENTS

| | | | |
|---|---|---|---|
| 4,425,894 | 1/1984 | Kato | 123/446 |
| 4,471,740 | 9/1984 | Jourde | 123/446 |
| 4,485,787 | 12/1984 | Kato | 123/446 |
| 4,628,881 | 12/1986 | Beck | 123/501 |
| 4,630,588 | 12/1986 | Sagawa | 123/506 |
| 4,718,384 | 1/1988 | Takahashi | 123/447 |
| 4,759,330 | 7/1988 | Kato | 123/447 |
| 4,779,599 | 10/1988 | Phillips | 123/447 |
| 4,805,580 | 2/1989 | Buisson | 123/447 |
| 4,831,982 | 5/1989 | Baranescu | 123/447 |

FOREIGN PATENT DOCUMENTS

| | | | |
|---|---|---|---|
| 0168050 | 10/1982 | Japan | 123/447 |

*Primary Examiner*—Carl Stuart Miller

*Attorney, Agent, or Firm*—Neuman, Williams, Anderson & Olson

[57] ABSTRACT

The present invention relates to a fuel injector for an internal combustion engine, which utilizes a fuel supply control valve and pilot or servo-valve to control the supply and drain of fuel to and from a main fuel chamber. More particularly, the pilot valve separates and isolates the main fuel chamber from the control valve which controls the fuel supply to the main fuel chamber. In this manner, the control valve can operate without interference from the fuel pressure fluctuations created in the main fuel chamber by a reciprocating plunger.

10 Claims, 3 Drawing Sheets

FIG. 1
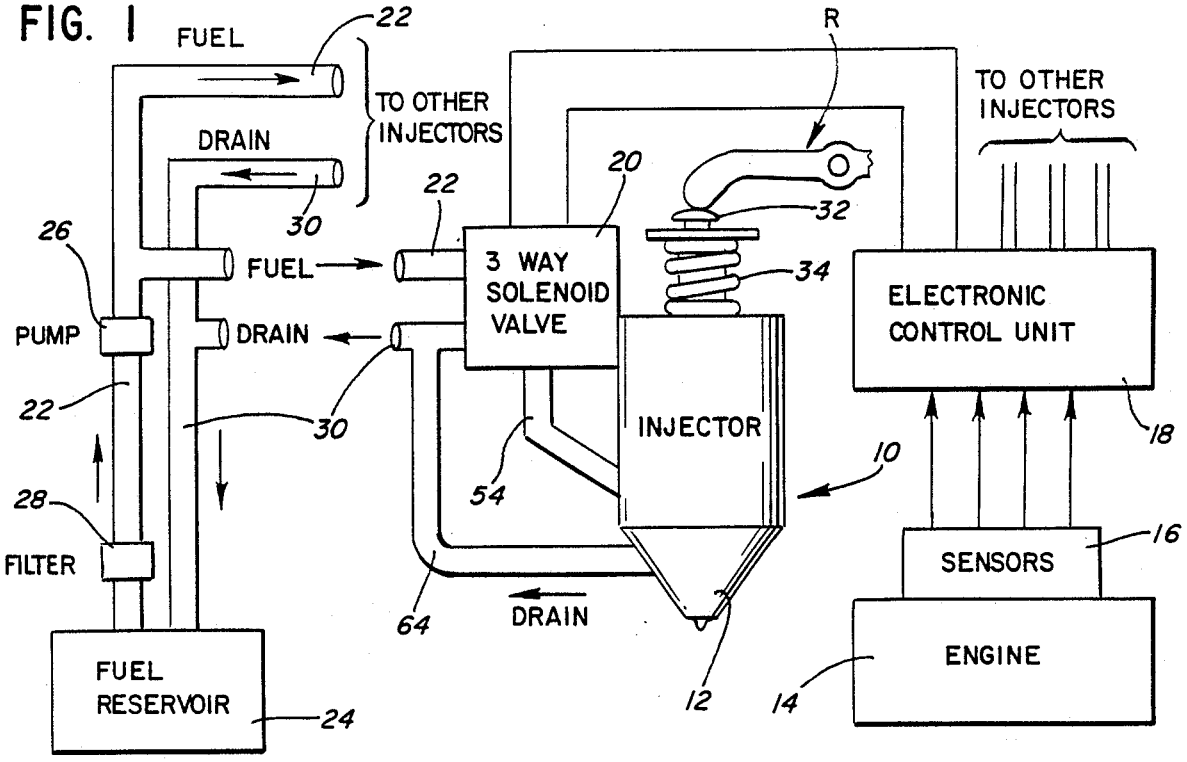
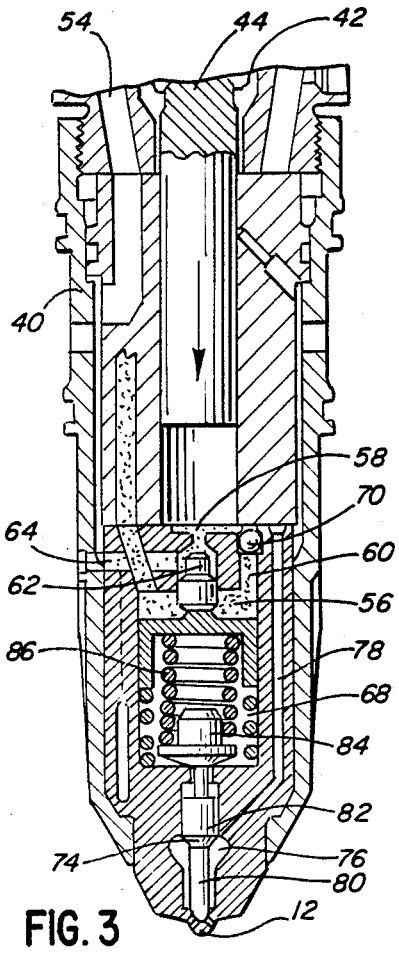
FIG. 3
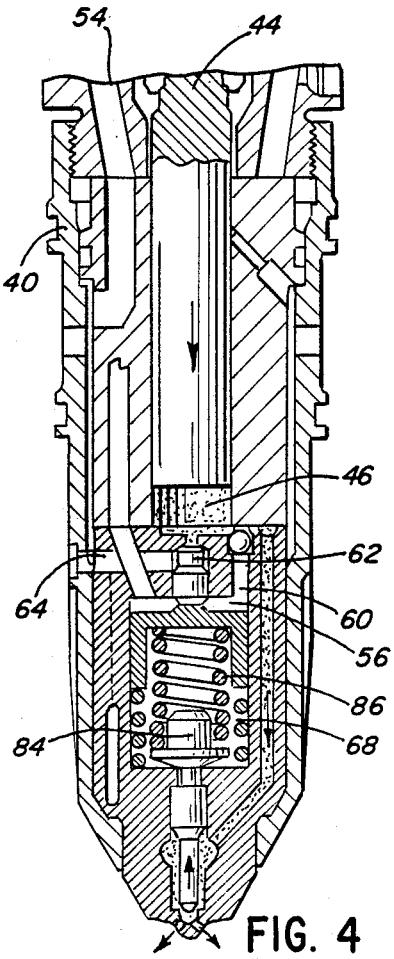
FIG. 4
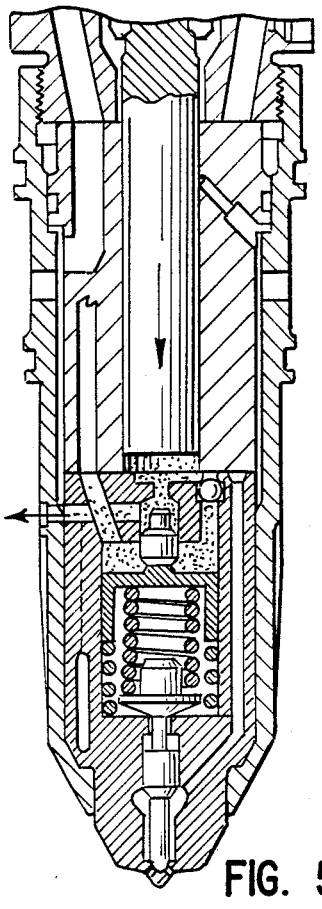
FIG. 5

FUEL INJECTOR FOR AN INTERNAL COMBUSTION ENGINE

FIELD OF THE INVENTION

The present invention relates to an electronically controlled fuel injector which incorporates a pilot or servo-valve to improve its accuracy, efficiency and responsiveness in comparison to conventional fuel injectors.

BACKGROUND OF THE INVENTION

Conventional fuel injectors typically employ two separate plungers or pistons which trap and compress two separate volumes of fuel. The first plunger is interconnected to the cam shaft and the second plunger is free floating within the fuel compression chamber. Fuel is delivered and removed from the fuel chamber by various networks of fuel lines having fuel ports positioned around the chamber walls. In addition, a control valve or switch is positioned along the fuel supply lines, between the chamber and the fuel reservoir, and controls the supply of fuel to the chamber. However, this type of injector has numerous inherent deficiencies.

First, because the fuel supply lines are routed directly to the fuel chamber, the control valve is exposed to the extreme changes in fuel pressure associated with the repeating injection cycle of engine operation. In particular, the control valve must operate under extreme conditions in which the fuel pressure may exceed 20,000 pounds per square inch during the compression phase. Consequently, in order to maintain the accuracy and efficiency of the overall system under these conditions, a bulky and costly control valve is required. This added cost increases the overall price of the engine and the necessary size of the valve requires it to be mounted apart from the injector thereby increasing the space requirements for the engine, increasing the length of the fuel lines running from the control switch to the fuel chamber and increasing the volume of fuel needed to fill the supply lines.

Second, conventional systems typically have numerous fuel ports spaced about the walls of the fuel chamber to allow fuel to enter and exit the chamber. This is especially true in dual plunger systems in order to accommodate the free floating plunger. However, the high fuel pressure created during the compression phase can cause the fuel chamber to expand or dialate which, in turn, causes fuel to leak from the various ports into the chamber. As a result, the fuel pressure will change, the fuel volume within the chamber will change, and consequently, the efficiency of the system, which depends upon consistent operating conditions, will decrease.

Third, conventional dual plunger injection systems, which utilize two separate trapped volumes of fuel, have a delayed response during fuel compression. The floating plunger acts like a resistive spring when converting the mechanical energy of the plunger into hydraulic energy and, as a result, it takes a longer period of time to reach injection pressure. Moreover, two separate volumes of fuel require more energy to compress in comparison to a single volume of lesser quantity. In addition, with the control switch mounted external to the injector as a result of its size, an additional volume of fuel is added to the total volume of fuel which must be compressed to the required level of injection pressure before the fuel can be injected into the engine cylinder. Consequently, conventional systems of this type require significant amounts of energy to operate and have long response times which as a result, make them less efficient.

A still further problem inherent in conventional fuel injectors is that they do not operate consistently between idle and high speeds. Because the injector is mechanically linked to the crankshaft, the plunger operates slower at idle and low engine speeds and faster at high engine speeds. As a result, the pressure created in the fuel chamber at low speeds may not be adequate to efficiently operate the engine. To remedy this, the profile of the operating cam can be changed so that the plunger moves fast enough at low speeds to create sufficient injector pressure. However, this typically creates too high of a pressure level at high engine speeds which can literally destroy the injectors. Consequently, a cam profile is typically chosen which balances the two extremes to create sufficient fuel injection pressure at all engine speeds. However, this type of balancing decreases the efficiency of the injector.

SUMMARY OF THE INVENTION

The present invention relates to a single plunger fuel injector which solves the foregoing problems found in conventional fuel injectors and, in addition, is constructed of substantially fewer parts making it easier to manufacture and assemble. In particular, the injector of the present invention utilizes a pilot or servo-valve to isolate the fuel supply control valve from the main fuel chamber. By eliminating the direct communication between the fuel chamber and the control valve, the control valve does not experience the high pressure conditions created during the compression phase of the injection cycle and, as a result, a more cost effective control valve can be employed without sacrificing system efficiency. Indeed, overall efficiency and responsiveness can be increased. Additionally, a smaller control valve can be utilized which will allow the control valve to be mounted on the injector body. In this way, the control valve will be positioned closer to the main fuel chamber and closer to the nozzle which will make the injector more efficient because less fuel will be necessary to fill the system.

In addition, the utilization of the pilot valve alters the manner in which fuel is supplied to and removed from the fuel chamber and, as a result, eliminates the need for fuel ports disposed on the fuel chamber wall and complex fuel passages interconnecting the various parts. Consequently, the injector does not experience fuel leakage during the high pressure conditions of fuel compression and is, therefore, more efficient and responsive.

The elimination of fuel ports in the chamber walls further allows the design of the injector to be simplified and the number of parts reduced. Particularly, the injector of the present invention employs a single plunger, rather than two plungers, and traps and compresses a single volume of fuel rather than two volumes of fuel. By decreasing or minimizing the volume of trapped fuel, the injector of the present invention further increases the efficiency and responsiveness of the overall fuel injection system. In addition, the main fuel chamber is located much closer to the nozzle than in conventional injectors which further minimizes the trapped volume of fuel. Accordingly, the injector of the present invention utilizes less energy to operate and is more efficient and more responsive than conventional fuel injectors.

Finally, the injector of the present invention is designed to operate consistently at either low or high engine speeds and to depressurize if the pressure reaches too high a level during fuel compression. This is accomplished by designing the cam to provide sufficient plunger speed during low speeds and also to design a safety feature into the servo-valve so that it automatically drains if pressure in the fuel chamber exceeds a level which could damage or destroy the injector. Thus, the injector will function at injection pressures of approximately 20,000 pounds per square inch but will automatically vent or drain itself if pressure in the main fuel chamber exceeds a level which would destroy the injector.

BRIEF DESCRIPTION OF THE DRAWINGS

For a more complete understanding of this invention reference should now be made to the embodiment illustrated in greater detail in the accompanying drawings and described below by way of examples of the invention.

FIG. 1 is a schematic diagram of a fuel injection system configured in accordance with the principles of the present invention.

FIGS. 2–5 are longitudinal cross sectional views of the preferred embodiment showing the same in various sequential stages of operation.

Figure 2:
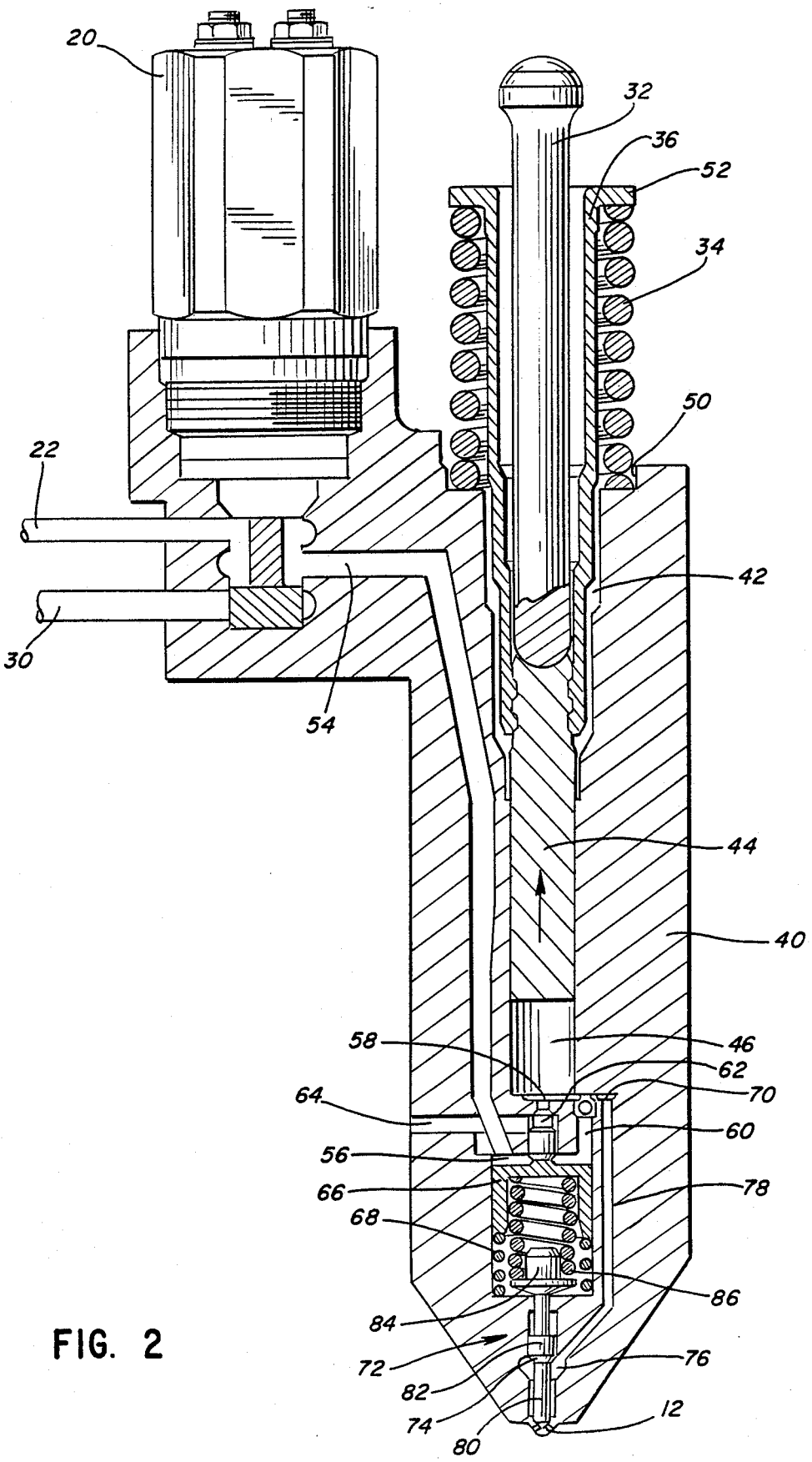

It should be noted, of course, that the drawings are only illustrative of the concepts described in greater detail below and that the invention is not necessarily limited to the particular embodiments illustrated herein.

DETAILED DESCRIPTION OF THE INVENTION

Turning now to the drawings, FIG. 1 schematically depicts the major components of the fuel injection system of the present invention. At least one fuel injector 10 is provided for each cylinder in the engine. However, for purposes of illustration, FIG. 1 only shows a single injector. Each fuel injector 10 is controlled to deliver fuel through a nozzle 12 directly into the combustion chamber of each cylinder and each injector 10 is operated in synchronism with the operation of the engine 14 so that fuel is provided to each cylinder at the appropriate time.

As further seen in FIG. 1, sensors 16 are mounted on the engine 14 for measuring certain engine parameters such as engine speed, temperature, turbo boost, manifold pressure, altitude, air-fuel ratio and throttle position. These sensors 16 generate electrical signals representative of the measured parameters and relay these signals to an electronic control unit 18 which analyzes and compares the input from the sensors 16 with reference values within a memory in the electrical control unit 18. The electronic control unit activates a control valve or switch 20 mounted in cooperation with the injectors 10 which controls the fuel supply to the injector. In the preferred embodiment, the control valve or switch 20 is a three way solenoid valve. The electronic control unit 18 transmits an electronic signal to the control valve 20 and regulates the period of time that the control valve is in each of its positions thereby controlling the supply of fuel to the injector 10 and ultimately, the supply of fuel to the combustion chamber of the engine. These types of sensors, solenoid valve and electronic control unit as well as their operation are well known in the art.

At the direction of the control valve 20, the fuel line 22 is opened and fuel is supplied from the reservoir 24 to each injector at a constant supply pressure of about 200–500 pounds per square inch by a fuel pump 26. The lower the supply pressure can be maintained, the more durable and cost effective the overall system will be. An in line filter 28 assures that the fuel is free from corrosive or destructive particles. At the appropriate time in the injection cycle, the control switch 20 closes the fuel supply line 22 and simultaneously opens a fuel drain line 30 which effectively seals the main fuel chamber and allows the compression phase of the injection cycle to increase the fuel pressure to an appropriate injection pressure.

While not shown in FIG. 1, each injector is mechanically operated in a conventional manner. Rotation of the engine crank shaft causes rotation in a cam shaft. In turn, the cam shaft translates its rotational movement into a reciprocating movement of multiple push rods. Each push rod, in turn, is connected to a rocker arm R which pivots about a fixed axis. Each rocker arm R, in turn, is in contact with an injector push rod 32. As seen in FIG. 2, the injector push rod 32 is seated within a hollow link 36. After the rocker arm depresses the injector push rod 32, a link spring 34, acting on the hollow link 36, returns each injector push rod 32 to its outwardly extended position.

As also can be seen in FIG. 2, the fuel injector 10 comprises a main body 40 which includes an axially extending central bore 42. A plunger 44 is reciprocally mounted within the bore and defines a main fuel chamber 46. The hollow cylindrical link 36 is connected to the outward end of the plunger 44 to extend the plunger out of the central bore. The exterior portion of the link 36 is biased in an outward direction by means of the link spring or compression spring 34 which is held in place between a recess 50 formed in the outer end of the injector body and a radial flange 52 formed at the outer edge of the link. An injector push rod 32 is received within the link 36 and is connected at its outer end to the rocker arm R. Movement of the rocker arm R causes the push rod 32 to force the plunger 44 into the main fuel chamber 46 and the action of the link spring returns the plunger to its outermost extended position.

A solenoid control valve 20 is mounted on the injector body 40 and controls the supply of and draining of fuel to and from the injector 10. In this manner, as explained below, the quantity of fuel injected into the engine cylinders can be metered and the initiation and completion can be timed. In the preferred embodiment, the solenoid control valve is a three way valve with a drain line 30 and supply line 22 connected to the valve and a control line 54 mounted within the injector body 40. The control line communicates between the control valve 20 and a fuel flow control chamber 56 positioned beneath the main fuel chamber 46. In operation, the control valve 20 either connects the fuel supply line 22 to the control line 54 to allow fuel to be supplied to the fuel flow control chamber 56 from the reservoir 24 or connects the fuel drain line 30 to the control line 54 to allow fuel to be drained from the fuel flow control chamber 56 to the reservoir 24. Of course, it is readily apparent and within the scope of this invention to employ multiple fuel control lines as well as multiple fuel supply and drain lines.

The fuel flow control chamber 56 communicates directly with the main fuel chamber 46 via an orifice 58 disposed at the bottom of the main fuel chamber 46 and by a fuel supply passage 60. The fuel supply passage 60 includes a check valve 70 which allows fuel to flow into the main fuel chamber 46 from the fuel flow control chamber 56 but prevents fuel from flowing in the opposite direction.

A reciprocable pilot plunger 62 is seated within the orifice 58 and moves in a passage 63 between an uppermost position in which the main fuel chamber is sealed from the drain line 64 and a lowermost position, withdrawn from the orifice, in which case the main fuel chamber 46 communicates with the drain line 64 via passage 63. The drain line 64 returns unused fuel from the main fuel chamber 46 to the fuel reservoir 24. The pilot plunger 62 is fixably secured to a pilot piston or valve 66 which, in turn, is biased in an upward direction by a pilot piston compression spring 68 to maintain the pilot plunger 62 seated in the orifice 58. Movement of the pilot plunger 62, at the direction of the control valve 20, determines the initiation and completion of the timing and metering phases of the injection cycle.

A needle valve 72 is used to control the opening and closing of the nozzle 12 disposed at the tip of the injector. A middle body portion 74 of the needle valve reciprocates vertically within a nozzle reservoir 76 which communicates with the main fuel chamber 46 via a fuel supply line 78. While only one fuel supply line 78 is shown, FIGS. 2–5, it is well understood that multiple supply lines could extend between the main fuel chamber 46 and the nozzle reservoir 76. The needle valve includes a lower portion 80 having an elongate cylindrical nose which seats within the nozzle to prevent fuel from exiting the injector and an upper portion 82 having a cylindrical body of greater diameter than the lower portion. The upper portion 82 is secured to a spring retaining member 84 which in turn is encompassed by a valve spring 86. Spring 86 is disposed between the pilot piston 66 and the spring retaining member 84 to bias the needle valve 72 downwardly and seat the nose portion 80 in the nozzle. As can be seen in FIGS. 2–5, the middle body 74 portion is tapered at the juncture with the lower nose portion so as to allow the fuel in the nozzle reservoir 76 to act on the middle body portion 74 and cause the needle valve 72 to move upwardly when sufficient fuel pressure is applied.

Turning now to the operation of the injector of the present invention, FIGS. 2–5 show a complete cycle of the injector. For purposes of illustration, the injector cycle will be described starting with the plunger 44 at its lowermost or bottom most position. At this point, the rocker arm R releases pressure on the push rod 32 which allows the main plunger 44 and link 36 to move upwardly under the force of the link spring 34 (FIG. 2). Simultaneously, under the direction of the electronic control unit 18, the solenoid control valve 20 connects the fuel supply line 22 to the control line 54 allowing fuel to flow into the fuel flow control chamber 56. The fuel flows directly to the fuel flow control chamber 56 without displacing the pilot plunger 62 and pilot piston 66 and passes directly into the main fuel chamber 46 through the fuel supply line 60. As the plunger continues its upward movement, the main fuel chamber 46 fills with fuel. The same quantity of fuel is drawn into the main fuel chamber during each upstroke of the main plunger 44.

FIG. 3 shows the fuel injector as the plunger 44 starts its downward stroke into the main fuel chamber 46. The down stroke of the plunger 44 forces the ball valve 70 to close line 60 whereupon the supply line 78 and the nozzle reservoir 76 are filled with fuel. With the ball valve 70 in a closed position and the control valve 20 allowing fuel to be supplied to the fuel flow control chamber 56, the supply of fuel entering the fuel flow control chamber 56 causes the pilot piston 66 to displace downwardly which, in turn, unseats the pilot plunger 62 from the orifice 58 at the bottom of the main fuel chamber 46. As the pilot plunger 62 is moved downwardly, against the combined resistive forces of the pilot piston compression spring 68 and the needle valve spring 86, at least a portion of the fuel in the main fuel chamber 46 exits and flows around the pilot plunger 62 into the drain line 64 and returns to the fuel reservoir 24. The initial draining or spilling of fuel prior to fuel injection preforms a timing function which controls the start of fuel injection into the engine cylinder. Specifically, while the pilot plunger 62 is unseated from the orifice 58, the main fuel chamber is in communication with the fuel reservoir which is at atmospheric pressure. Consequently, injection pressure cannot be achieved within the injector body, the nozzle valve cannot be opened and fuel cannot be injected into the engine cylinder. The length of time the main fuel chamber is allowed to drain is controlled by the operation of the control valve 20 at the command of the electronic control unit 18 and thus determines the amount of fuel remaining in the main fuel chamber 46 and the amount of fuel which is available for injection into the engine cylinder. Depending upon the operating conditions of the engine of any given time, the quantity of fuel initially spilled to the reservoir can vary from a relatively large quantity to little or nothing.

On the appropriate command from the electronic control unit 18, the solenoid control valve 20 disconnects the supply line 22 from the control line 54 and connects the control line to the drain line 30. With the control line 54 no longer subject to a constant supply of pressurized fuel, the pilot piston spring 68 and needle valve spring 86 force the pilot piston 66 upwardly which displaces the fuel in the fuel flow control chamber 56. The displaced fuel is forced into the control line 54 and returns to the fuel reservoir 24. When the pilot piston 66 has moved to its uppermost position, the pilot plunger 62 will again be seated in the orifice 58 of the main fuel chamber 46 thereby preventing the spill of further fuel to the fuel reservoir. This marks the end of the timing phase of the injection cycle and initiates the metering phase during which the appropriate amount of fuel is injected into the engine cylinder based upon the then current demands being placed on the engine by the driver.

With the pilot plunger 62 seated in the orifice 58, further downward movement of the plunger 44 compresses the fuel remaining within the main fuel chamber 46 increasing the pressure of the fuel therein. In the preferred embodiment, the combined forces of pilot piston compression spring 68 and the needle valve spring 86 are designed to withstand approximately 20,000 pounds per square inch of downward pressure. Pressures which exceed this level can destroy the injector.

Continued downward movement of the plunger 44 increases the pressure in the nozzle reservoir 76 to the point that injection pressure is reached and the forces acting on the tapered segment of the middle body portion 74 force the needle valve 72 upwardly opening the nozzle 12 and allowing the downward motion of the plunger 44 to inject fuel into the combustion cavity of the engine cylinder. In the preferred embodiment, approximately 4,000 pounds per square inch of pressure is needed to move the needle valve 72. Because the pressure in the fuel chamber can reach approximately 20,000 pounds per square inch, the diameter of the orifice 58 is designed smaller than the diameter of the injection supply line 78 so that the pilot piston spring 68 and needle valve spring 86 can easily withstand the increase of pressure at the orifice during the downstroke of the plunger 44. However, the resistive forces of the pilot piston spring 68 and the needle valve spring 86 are also designed to yield if the pressure in the fuel chamber reaches a dangerous and destructive level. In that situation, the pilot plunger 62 would be forced downwardly and the fuel chamber would be connected to the drain line 64. This would immediately reduce the pressure and prevent damage to the injector.

When the appropriate amount of fuel has been injected into the engine cylinder based upon then-current engine conditions, the electronic control unit 18 provides an appropriate signal to activate the solenoid control valve 20 to thereby disconnect the control line 54 from the drain line 30 and reconnect the control line 54 to the fuel supply line 22. As a result, the pilot piston 66 is again displaced by the accumulation of fuel in the fuel flow control chamber 56 and the pilot plunger 62 is again unseated from the orifice 58 in the bottom of the main fuel chamber 46. Thus, the remainder of the down stroke of the plunger 44 forces any remaining fuel from the main fuel chamber 46 into the drain line 64 and the resulting loss of pressure in the injection line 78 and nozzle reservoir 76 causes the needle valve spring 86 to lower the needle valve 72 to close the nozzle.

At this point, the plunger 44 will have completed its downstroke, thereby evacuating the main fuel chamber 46 of any fuel, and the injector is ready to initiate another cycle. It is understood that the control valve 20 can be switched at any point in time thereby providing variable timing and metering phases which allows the injection to be responsive to changing engine conditions. For example, the injector can be operated to spill fuel prior to injection and inject the remaining quantity of fuel without any post injection spill, or injection can start immediately after the main fuel chamber is filled without any spill prior to injection, or varying quantities of fuel can be spilled both prior to and after injection. In this manner, the injector can accommodate and respond to changing engine conditions.

Figure 6:
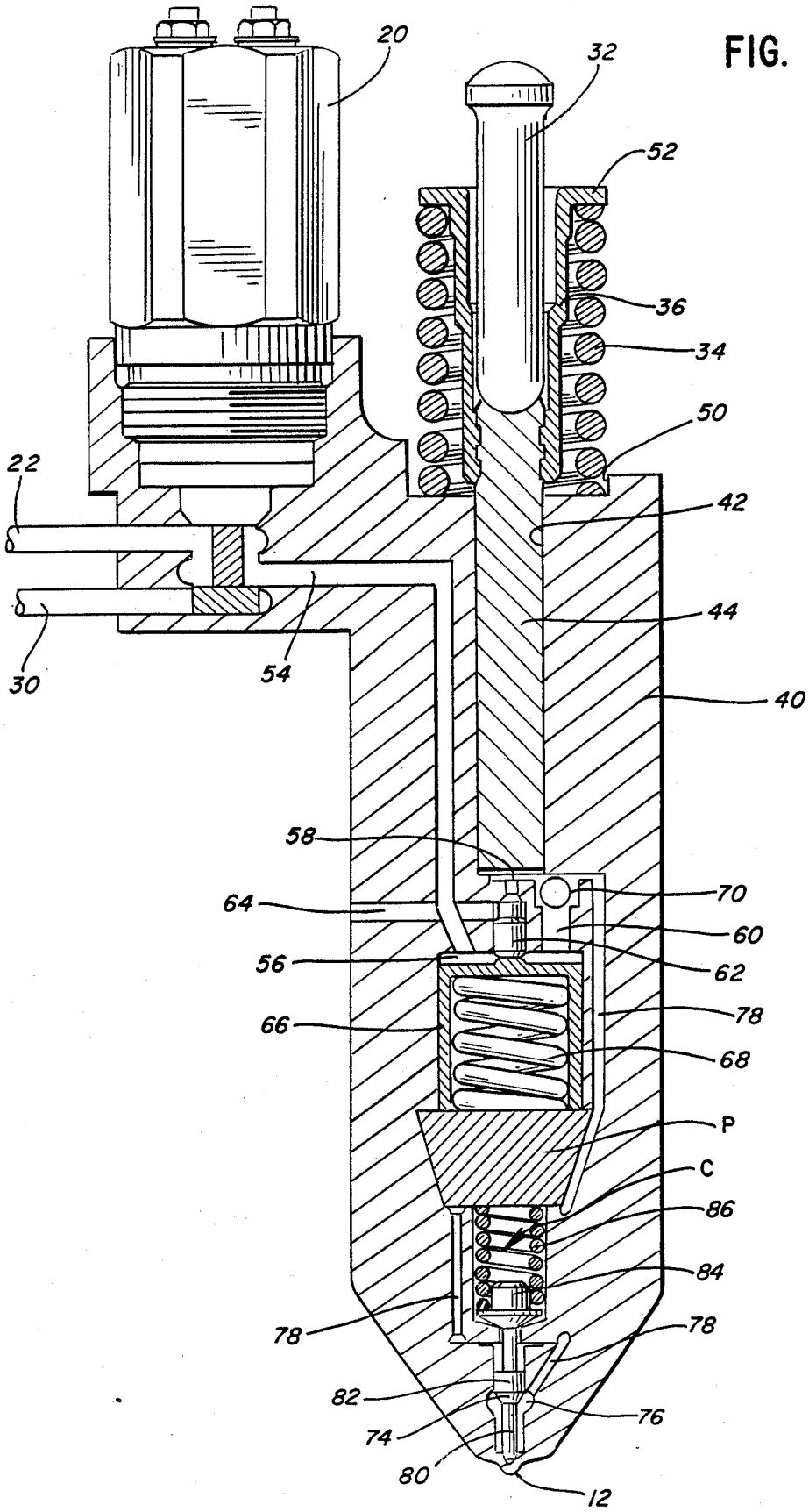
FIG. 6 is a longitudinal cross sectional view of an alternative embodiment of the present invention.

In the alternative embodiment shown in FIG. 6, the fuel injector is virtually identical to the fuel injector shown in FIGS. 2–5 except that the pilot piston valve and the needle valve have been separated. When the two valves are combined, as in the preferred embodiment, a larger fuel supply pressure is required to overcome the combined effects of the pilot valve compression spring 68 and the needle valve compression spring 86 than in this alternative embodiment.

In the embodiment of FIG. 6, a plug P is inserted into the axial bore 42 beneath the fuel flow control chamber 56 and a cavity C is formed by the axial bore to accommodate the needle valve spring 86. The pilot valve compression spring 68 is held in place between the pilot valve 66 and the plug P and the needle valve compression spring is held in place between the plug P and the spring retaining member 84. Thus, for the fuel supply pressure to displace and the pilot valve 66 and the pilot plunger 62 to allow the main fuel chamber 46 to vent to the drain, the fuel supply pressure must only overcome the resistance of the pilot valve compression spring 68, rather than the combined effect of the pilot valve compression spring 68 and the needle valve compression spring 86. Similarly, for the fuel pressure to open the needle valve, the fuel blank pressure need only increase to a level which overcomes only the needle valve compression spring 86 rather than the combined effect of the pilot valve spring 68 and the needle valve spring 86. By separating the operation of the needle valve and pilot valve, the fuel injection pressure necessary to displace the needle valve and the fuel supply pressure necessary to displace the pilot valve can be independently adjusted without having to compensate and adjust the compression spring of the other valve. In addition, separating the springs in this manner allows the fuel from control valve to be displaced with a lower fuel pressure. In particular, a blank 2 fuel supply pressure of approximately 200 pounds per square inch is sufficient to displace the pilot valve in the alternative embodiment while in the embodiment of FIG. 1, a fuel supply pressure of approximately 500 pounds per square inch is required to displace the pilot valve. The lower supply pressure allowed by the alternative embodiment will allow the system to utilize a less powerful and less expensive fuel pump and will also make the overall system more durable by allowing the components to operate under a decreased load.

Whereas a preferred embodiment and alternative design have been shown and described herein, it will be apparent that other modifications, alterations and variations may be made by and will occur to those skilled in the art to which this invention pertains, particularly upon considering the foregoing teachings. It is, therefore, contemplated by the appended claims to cover any such modifications and other embodiments as incorporate those features which constitute the essential features of this invention within the true spirit and scope of the following claims.

What I claim is:

1. A fuel injector for an internal combustion engine comprising:

a body having a proximal end and a distal end and a central bore extending axially from said proximal end to said distal end, said bore defining a main fuel chamber and a fuel flow control chamber spaced axially from and communicating with said main fuel chamber;

a reciprocating plunging member positioned within said main fuel chamber;

a nozzle disposed at the distal end of the central bore and communicating with said main fuel chamber;

valve means disposed within said distal end of said bore and axially moveable to open and close said nozzle to allow fuel to exit the injector and enter an engine cylinder;

a first fuel passage within said body for supplying fuel at a supply pressure to said fuel flow control chamber, a second fuel passage for communicating fuel from said main fuel chamber to said nozzle, a third fuel passage for communicating fuel from said fuel flow control chamber to said main fuel chamber and a fourth fuel passage for draining said fuel from said main fuel chamber;

a control valve having a first port communicating with a source of pressurized fuel, a second port communicating with a fuel drain and a third port communicating with said first fuel passage, said control valve when in a first mode being positioned to effect interconnection of said first and third ports to allow fuel to be supplied from said pressurized fuel source to said fuel flow control chamber and when in a second mode being positioned to effect interconnection of said second and third ports to allow fuel to drain from said fuel flow control chamber; and, fuel flow control means disposed within said fuel flow control chamber and responsive to the mode of said control valve for controlling the flow of fuel into and out of said main fuel chamber and for isolating said control valve from fuel pressure fluctuations caused in the main fuel chamber by the reciprocating movement of said plunging member.

2. The fuel injector of claim 1, wherein said fuel flow control means includes a fuel flow valve adjustably positionable between a first position wherein said fourth fuel passage is closed and a second position wherein said fourth fuel passage is open.

3. The fuel injector of claim 2, wherein said fuel flow valve is a pilot valve.

4. The fuel injector of claim 1 wherein a check valve is positioned in said third fuel passage for allowing fuel to flow from said fuel flow control chamber to said main fuel chamber and for preventing fuel from flowing from said main fuel chamber to said fuel flow control chamber.

5. The fuel injector of claim 1, wherein said valve means is an axially reciprocable needle valve.

6. The fuel injector of claim 1, wherein said control valve is a three way solenoid operated valve.

7. The fuel injector of claim 1, wherein said fuel flow control means includes safety means for automatically draining said main fuel chamber when the pressure in said main fuel chamber exceeds a predetermined level.

8. In a fuel injector for an internal combustion engine having a main fuel chamber and a plunging member axially moveable therein, a nozzle disposed at the distal end of the injector and communicating with the main fuel chamber, a fuel pressure responsive needle valve operatively associated with the nozzle to allow fuel to flow into the engine cylinder when the fuel pressure within the nozzle reaches a predetermined amount and a fuel flow control passage in communication with the main fuel chamber, the improvement comprising:

a control valve operatively associated with the fuel flow control passage, said control valve having a first port communicating with a source of pressurized fuel, a second port communicating with a fuel drain and a third port communicating with the fuel flow control passage, said control valve when in a first mode being positioned to effect interconnection of said first and third ports and supply pressurized fuel to the fuel flow control passage and when in a second mode being positioned to effect interconnection of said second and third ports and allow fuel in the fuel flow control passage to drain, and fuel flow valve means disposed between the fuel flow control passage and the main fuel chamber to isolate operation of the control valve from the fuel pressure fluctuations created in the main fuel chamber by the reciprocating movement of the plunging member.

9. A fuel injector for an internal combustion engine comprising:

a body having an axial extending bore, said bore defining a main fuel chamber and a fuel flow control chamber, a plunging member disposed in said main fuel chamber for axial movement therein, an orifice interconnecting said main fuel chamber and said fuel flow control chamber, a nozzle disposed at the end of said bore remote from said plunging member, a first fuel passage interconnecting said fuel flow control chamber and main fuel chamber, said first fuel passage including a one-way valve which allows fuel to flow from said fuel flow control chamber to said main fuel chamber but prevents fuel from flowing from said main fuel chamber to said fuel flow control chamber, a second fuel passage interconnecting said main fuel chamber and said nozzle, valve means disposed within said bore adjacent said nozzle for opening and closing said nozzle, a control valve operatively associated with the injector, said control valve having a first port communicating with a source of pressurized fuel, a second port communicating with a fuel drain, and a third port communicating with said fuel flow control chamber, said control valve, when in a first mode, being positioned to effect interconnection of said first and third ports and allow pressurized fuel to be supplied from said source to said fuel flow control chamber and when in a second mode being positioned to effect interconnection of said second and third ports and allow fuel to drain from said fuel flow control means, and fuel flow valve means disposed in said fuel flow control chamber for opening and closing said orifice to control fuel flow from said main fuel chamber to said fuel flow control chamber, said fuel flow valve means being operatively associated with said control valve and plunging member is moving away from said orifice, said control valve is simultaneously allowing fuel to flow to said fuel flow control chamber and said fuel flow valve means to close said orifice and cause the fuel to flow into said main fuel chamber through said first fuel passage; when said plunging member is moving towards said orifice, said control valve is simultaneously allowing fuel to flow to said fuel flow control chamber and said fuel flow valve means to open said orifice and allow fuel to drain from said main fuel chamber and collect in said fuel flow control chamber, and when said plunging member has moved a predetermined distance towards the orifice, said control valve simultaneously allows the fuel to drain from said fuel flow control chamber and said fuel flow valve means to close said orifice and open said nozzle means to allow fuel to exit the injector into a cylinder of the engine.

10. The fuel injector of claim 9, wherein said fuel flow valve is a pilot valve.

* * * * *